US005798984A

United States Patent [19]

Koch

[11] Patent Number: 5,798,984

[45] Date of Patent: Aug. 25, 1998

[54] TIMEPIECE INCLUDING A RECEIVING AND/OR TRANSMITTING ANTENNA FOR RADIO BROADCAST SIGNALS

[75] Inventor: Daniel Koch, Crémines, Switzerland

[73] Assignee: Eta SA Fabriques d'Ebauches, Grenchen, Switzerland

[21] Appl. No.: 974,462

[22] Filed: Nov. 20, 1997

[30] Foreign Application Priority Data

Nov. 22, 1996 [CH] Switzerland ..... 2890/96

[51] Int. Cl.[6] ..... G04B 47/00; G04C 11/02; H01Q 1/12

[52] U.S. Cl. ..... 368/10; 368/47; 368/294; 343/718

[58] Field of Search ..... 368/10, 47, 88, 368/276, 278, 280, 294–296; 343/718, 872, 878

[56] References Cited

U.S. PATENT DOCUMENTS

| | | | |
|---|---|---|---|
| 5,367,502 | 11/1994 | Barroso et al. | 368/10 |
| 5,532,705 | 7/1996 | Hama | 343/718 |
| 5,696,518 | 12/1997 | Itoh et al. | 343/718 |

FOREIGN PATENT DOCUMENTS

| | | |
|---|---|---|
| 0 382 130 | 8/1990 | European Pat. Off. . |
| 0 564 236 | 10/1993 | European Pat. Off. . |
| 0 741 433 | 11/1996 | European Pat. Off. . |
| 686 696 | 6/1996 | Switzerland . |

*Primary Examiner*—Vit W. Miska

*Attorney, Agent, or Firm*—Griffin, Butler, Whisenhunt & Szipl

[57] ABSTRACT

Timepiece including a case, a bezel and a transponder including a radio broadcast signal transmitting and/or receiving circuit and an antenna connected to that circuit, the antenna and the transmitting and/or receiving circuit being both fixed to the bezel wherein they are, for example arranged in an appropriate recess.

11 Claims, 3 Drawing Sheets

TIMEPIECE INCLUDING A RECEIVING AND/OR TRANSMITTING ANTENNA FOR RADIO BROADCAST SIGNALS

The present invention concerns a timepiece including a receiving and/or transmitting antenna for radio broadcast signals.

Timepieces of this type, which are often made in the form of a wristwatch, are used in various applications. They are sometimes intended to communicate with a device from a distance, for example, in a system for identifying objects. In such a system, each wristwatch includes a memory device containing an identification code unique to such wristwatch, a radio broadcast signal transmitting and receiving circuit and an antenna connected to the latter.

A system of this type also includes a central transceiver arranged to transmit an interrogation signal. Detection of this signal generates transmission of an identification signal by the wristwatch in question, this signal being representative of the identification code stored in its memory device. Thus, by identifying the wristwatch which belongs to each identification signal, the central transceiver can check the identity of the wearer of the wristwatch.

Swiss Patent Application CH 686 696 discloses a wristwatch in which the antenna is placed in an internal recess of the middle part and the bezel. This antenna is electrically connected to a radio broadcast signal transmitting and receiving circuit which is arranged under the dial of the wristwatch. The radio broadcast signal transmitting and receiving circuit and the antenna are supplied by a battery housed in the lower portion of the wristwatch case.

This arrangement allows an antenna of the largest possible dimensions to be installed in the case, taking account of the dimensions of the wristwatch, so as to offer the greatest effective cross-section possible to the electromagnetic fields. Moreover, housing the antenna in the vicinity of the bezel allows the distance between the antenna and a source of radio broadcast signals to be minimised by bringing the wristwatch closer to such source.

However, such an arrangement has a certain number of drawbacks.

The ends of the wire forming the antenna housed in an internal recess of the middle part and/or the bezel must be connected to the circuit housed within the case in the space usually reserved for the clockwork movement. This connection is achieved via complex and expensive means. Then, it is difficult to change the antenna and/or the radio broadcast signal transmitting and receiving circuit and this requires opening the case and disassembling the elements housed therein.

Moreover, connection of the antenna to the radio broadcast signal transmitting and receiving circuit is carried out when the timepiece is assembled, which complicates the manufacturing thereof and there is a risk of poor electric contact in the embodiment of said proposed connection.

This wristwatch is thus expensive and limited in its use, the circuit being generally dedicated to a specific application and the transponder being permanently attached to the watch in which it is arranged during manufacturing of such watch.

Thus, an object of the present invention is to provide a timepiece including a receiving and/or transmitting antenna for a radio broadcast signal which overcomes the drawbacks of the aforementioned prior art.

Moreover, another object of the invention is to provide a timepiece including a receiving and/or transmitting antenna for a radio broadcast signal which is simple and reliable to manufacture.

Another object of the invention is to provide a timepiece including a receiving and/or transmitting antenna which facilitates the change or replacement of the antenna and/or the radio broadcast signal transmitting and/or receiving circuit.

The present invention therefore concerns a timepiece including a case, a bezel and a transponder including a radio broadcast signal transmitting and/or receiving circuit and an antenna connected to the transmitting and/or receiving circuit. The timepiece is characterised in that the antenna and the transmitting and/or receiving circuit are both fixed to the bezel.

Thus the transponder may be assembled before being assembled to the bezel of the timepiece, in a reliable manner. Moreover, by simply disassembling the bezel or changing the bezel, it is possible to change or replace the transponder attached to a given timepiece.

Other features and advantages of the present invention will appear upon reading the detailed description which follows, made with reference to the annexed drawings, given here solely by way of example and in which.

Figure 1:
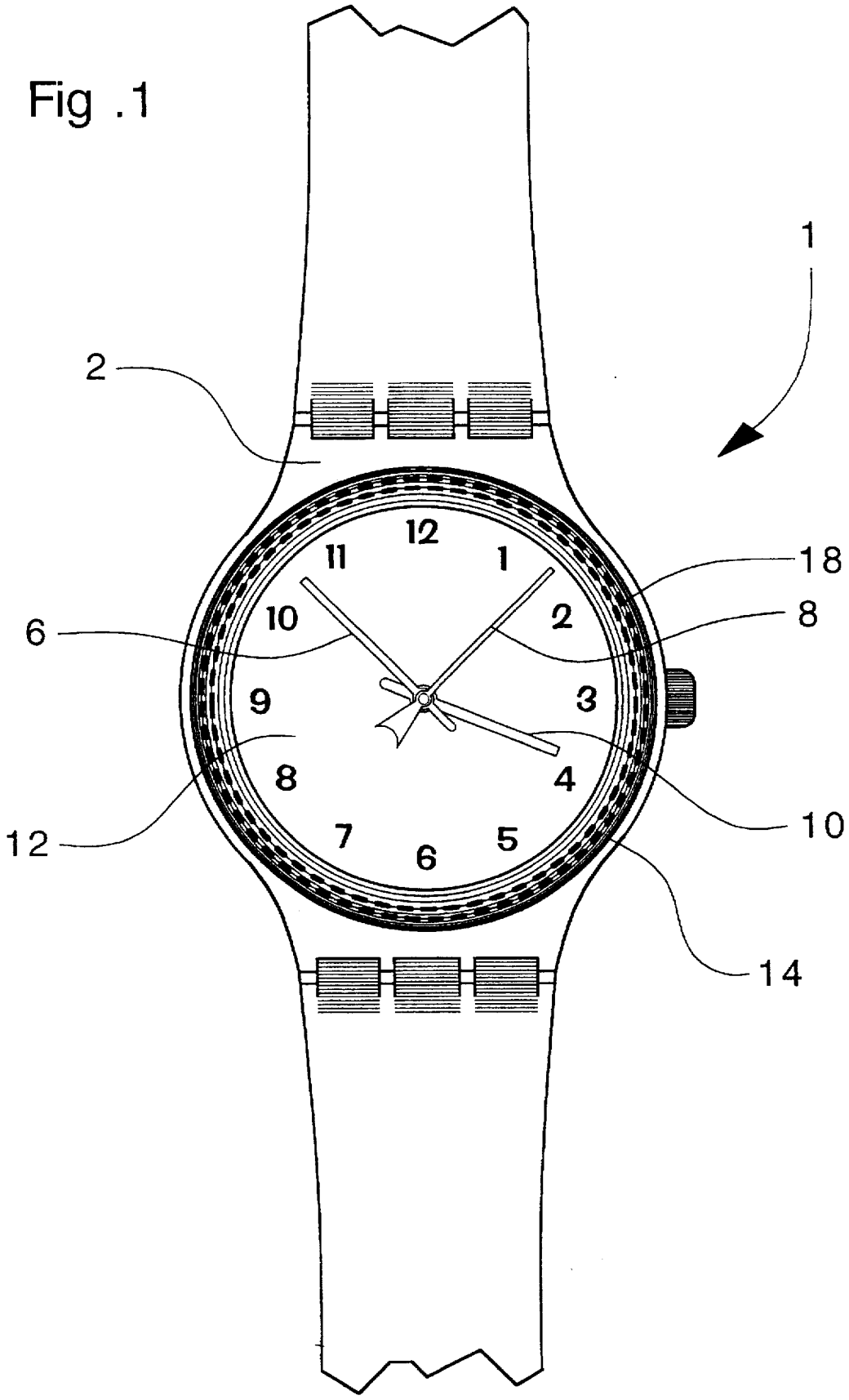
FIG. 1 is a top view of an embodiment of the timepiece according to the present invention.
Figure 2:
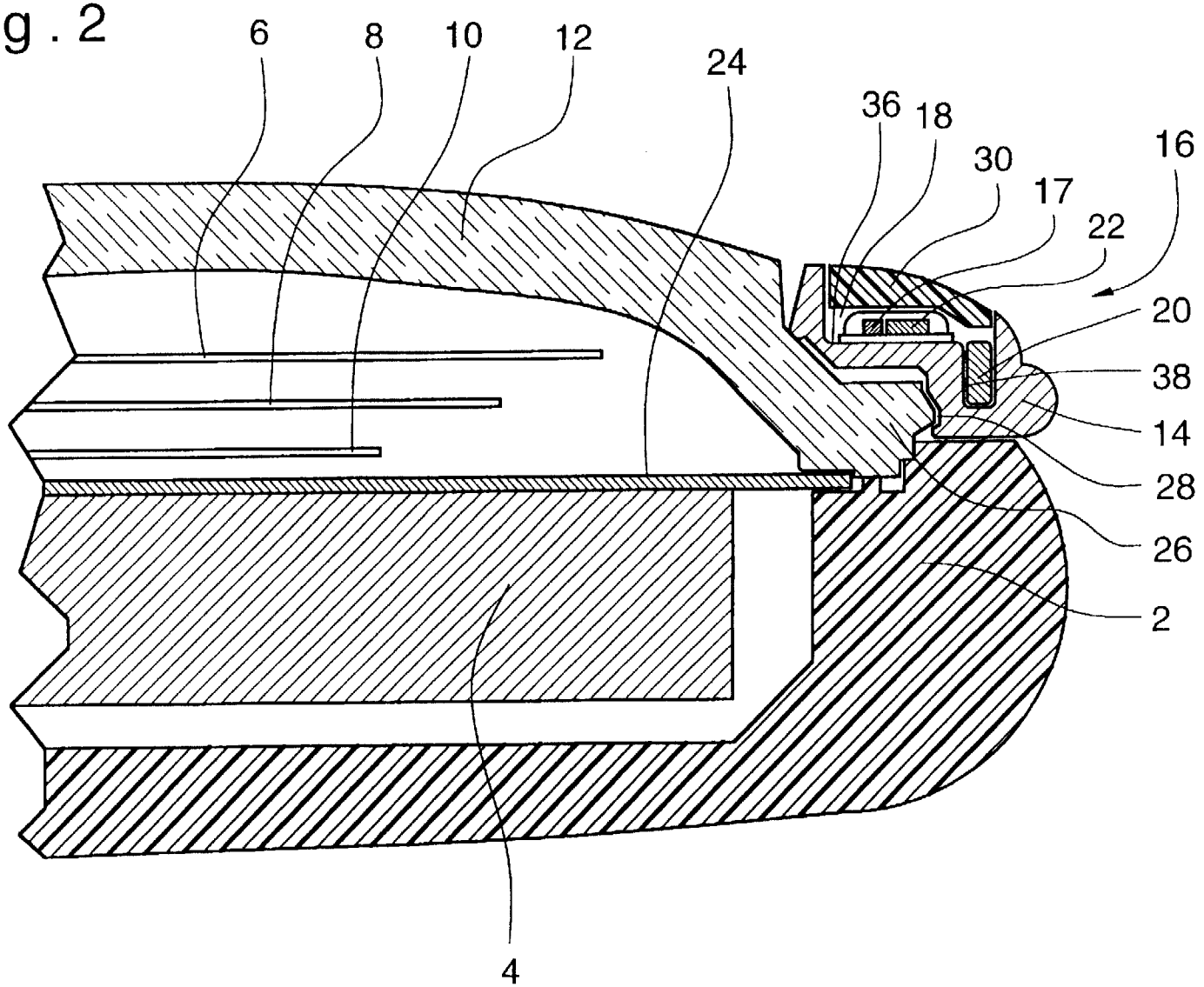
FIG. 2 is a cross-section of the timepiece of FIG. 1.

Referring to FIGS. 1 and 2, a timepiece according to the invention, designated here by the general reference 1 will be described hereinafter. Timepiece 1 includes in the conventional manner a case which includes a middle part 2 and a crystal 12. Middle part 2 is made, for example, of plastic material via a well known injection moulding technique.

Timepiece 1 further includes a clockwork movement 4 which is housed within middle part 2 and which is mechanically coupled to display means 6, 8 and 10 formed respectively by a second hand, a minute hand and an hour hand.

Timepiece 1 is sealed by crystal 12. This latter is mounted in a fixed manner on middle part 2 in a conventional manner, for example by bonding or an ultrasound welding technique. A bezel 14 is mounted on the case, namely on crystal 12 and/or middle part 2.

Wristwatch 1 further includes a transponder 16 including an antenna 20 and a radio broadcast signal transmitting and/or receiving circuit 22, these elements being well known to the man skilled in the art. According to the invention, antenna 20 and said circuit 22 are integrated within bezel 14. Thus, the horological portion (middle part, crystal, movement, dial, hands, etc.) and the receiving and/or transmitting portion (antenna, circuit) of the wristwatch may be designed, manufactured and tested completely separately from each other before the final assembly of the wristwatch.

Transponder 16 further includes supply means for circuit 22. Supply means 22 may be formed by a source of energy such as a battery, or, preferably, by a rectifier circuit for the signals picked up by said antenna 20. In the latter case, its is easier to integrate transponder 16 completely within bezel 14 for the purposes of space requirement.

Bezel 14 is preferably mounted on the case in a removable manner. For this purpose, in the example shown in FIG. 2, crystal 12 and bezel 14 include respectively a protruding portion 26 and a groove 28 which are complementary so that the bezel is held in place around the case. Bezel 14 may be manufactured in a material able to be deformed elastically so that bezel 14 is removable, i.e. it may be assembled on the case and disassembled or removed from the latter by simple pressure.

The fact that bezel 14 is removable allows easy selection and change of the communication system (i.e. the transmitting and/or receiving circuit) or resonance frequency of the unit formed by the antenna and the transmitting and/or receiving circuit, as a function of the desired country or service. Moreover, such an arrangement allows the case and the bezel to be sold separately. The consumer may thus both choose a wristwatch which suits him and match a bezel containing the antenna and the transmitting and/or receiving circuit corresponding to the required service to his wristwatch. The separation of the horological elements from the antenna and the transmitting and/or receiving circuit allows an inexpensive receiver or a transponder to be made which can be attached to a wristwatch in a removable manner.

It will be noted that one may envisage, in certain embodiments, disassembling at least partially the bezel so as to remove the transponder module in order to replace it with another module, which does not require use of a removable bezel.

In FIG. 2, bezel 14 includes a mounting recess 18 in which antenna 20 and radio broadcast signal transmitting and/or receiving circuit 22 are housed. Recess 18 preferably has an annular shape which follows that of bezel 14.

Antenna 22 has an annular shape. This antenna may be formed by a coil or winding including one or more turns arranged in a substantially parallel plane to that of dial 24 of wristwatch 1. However, the present invention can be applied to any shape of antenna capable of being integrated within a bezel.

Recess 18 is formed in an external surface of bezel 14, i.e. in a surface seen by the user when he looks at the wristwatch when wearing it. Recess 18 is sealed by a transparent cover 30 in order to make antenna 20 and transmitting and/or receiving circuit 22 visible to the user, this by no means being a limiting choice. Cover 30 seals recess 18 and protects antenna 20.

It is to be noted that such an arrangement does not use any space under dial 24 which thus remains available for housing other components of wristwatch 1.

If cover 30 is not removable, bezel 14 housing antenna 20 and transmitting and/or receiving circuit 22 may, in the event that antenna 20 or circuit 22 do not function properly or are not suited to a desired application, easily be replaced by another bezel.

Recess 18 may also be filled at least partially by fixing means, such as an adhesive material or a synthetic resin, in order to improve the assembly stability of antenna 20 and transmitting and/or receiving circuit 22 in bezel 14.

Referring to FIG. 2, one can seen that mounting recess 18 includes two non-coplanar surfaces 36 and 38, on which are mounted respectively circuit 22 and antenna 20. Thus the dimensions, placing and orientation of antenna 20 and circuit 22 may be optimised with respect to that of bezel 14.

Figure 3:
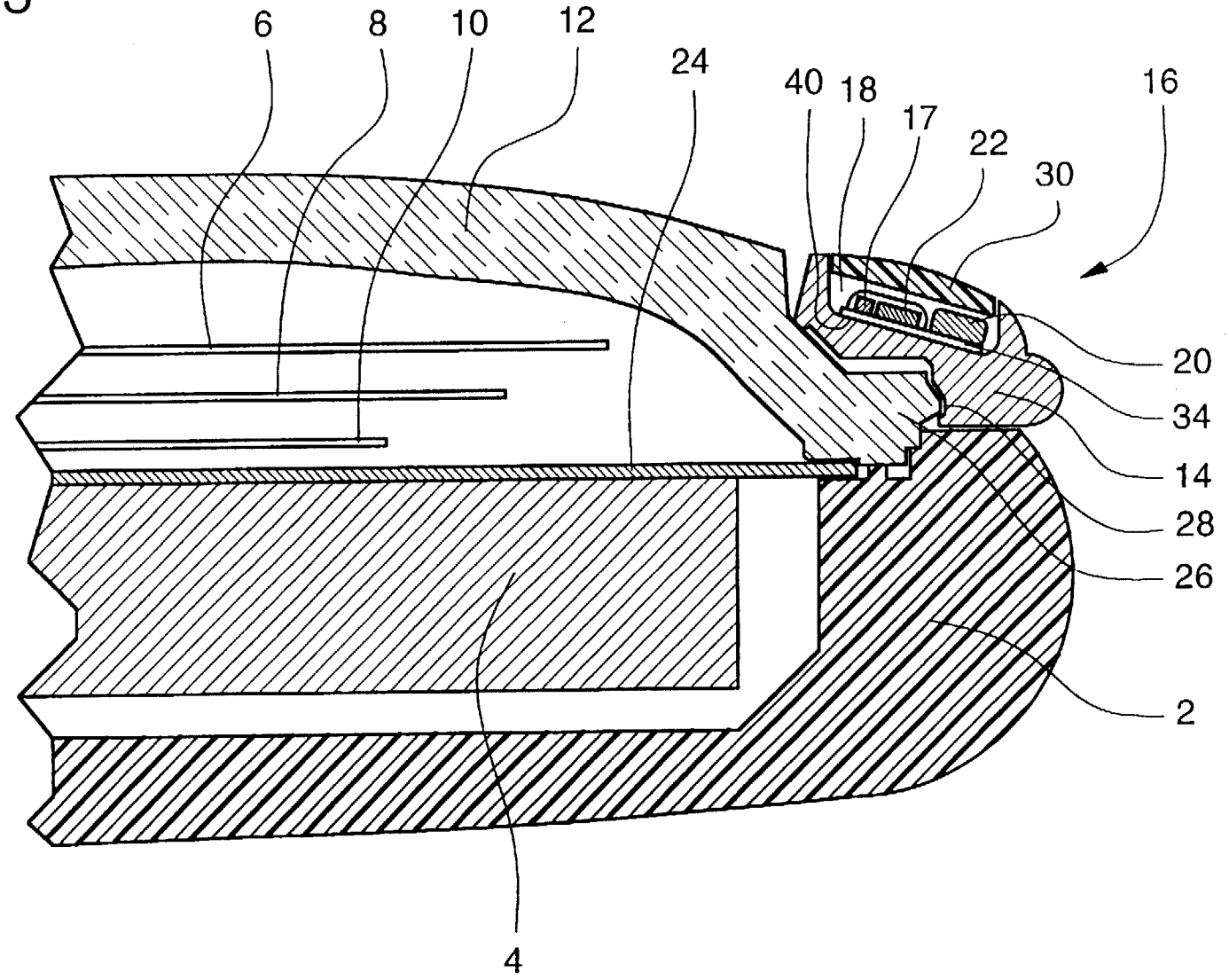
FIG. 3 is a cross-section of an alternative embodiment of the timepiece of FIG. 1.

FIG. 3 shows an alternative embodiment of the timepiece described hereinbefore.

According to this alternative, mounting recess 18 includes a substantially plane surface 40 on which antenna 20 and transmitting and/or receiving circuit 22 are mounted.

Antenna 20 and circuit 22 are preferably mounted on a common base plate 34 before being housed in recess 18 in order to facilitate the assembly of the transponder in bezel 14.

Finally, it is to be noted that several modifications may be made to the timepiece according to the invention without departing from the scope thereof. In particular, the transponder may be embedded in a material forming the bezel, the latter being obtained via injection moulding of such material and the transponder being initially placed in the injection mould.

What is claimed is:

1. A timepiece including a case, a bezel and a transponder including a radio broadcast signal transmitting and/or receiving circuit and an antenna connected to said transmitting and/or receiving circuit, wherein said antenna and said transmitting and/or receiving circuit are both fixed to said bezel.

2. A timepiece according to claim 1, wherein said transponder also includes means for supplying the transmitting and/or receiving circuit which are also fixed to said bezel.

3. A timepiece according to claim 1, wherein said transponder is completely integrated within said bezel.

4. A timepiece according to any of the preceding claims, wherein said bezel is mounted on said case in a removable manner.

5. A timepiece according to claim 1, wherein said bezel includes a mounting recess in which are mounted said antenna and said transmitting and/or receiving circuit.

6. A timepiece according to claim 5, wherein said mounting recess is provided in a surface of said bezel forming an external surface of said timepiece.

7. A timepiece according to claim 5, wherein said recess is sealed by a cover.

8. A timepiece according to claim 5, wherein said mounting recess includes two non-coplanar surfaces on which said antenna and said transmitting and/or receiving circuit are mounted.

9. A timepiece according to claim 5, wherein said mounting recess includes a planar surface, wherein said antenna and said transmitting and/or receiving circuit are mounted on a common base plate and wherein said common base plate is arranged on said planar surface.

10. A timepiece according to claim 1, wherein said bezel is made by injection of material in a mould, said transponder being placed in the mould before the material is injected so that the transponder is embedded in said bezel material.

11. A timepiece according to claim 6, wherein said recess is sealed by a cover.

* * * * *